US007375734B2

(12) United States Patent
Chin et al.

(10) Patent No.: US 7,375,734 B2
(45) Date of Patent: May 20, 2008

(54) GAMMA ADJUSTMENT METHOD FOR MULTI-CHANNEL DRIVER OF MONITOR AND DEVICE OF THE SAME

(75) Inventors: Hsu-Yuan Chin, Hsinchu (TW); Yu-Chun Chuang, Sanwan Hsiang (TW); Han-Hui Chiu, Fengshan City (TW); Cheng-Han Hsieh, Chupei City (TW)

(73) Assignee: Silicon Touch Technology Inc., Hsinchu (TW)

( * ) Notice: Subject to any disclaimer, the term of this patent is extended or adjusted under 35 U.S.C. 154(b) by 446 days.

(21) Appl. No.: 11/102,516

(22) Filed: Apr. 8, 2005

(65) Prior Publication Data

US 2006/0227155 A1 Oct. 12, 2006

(51) Int. Cl.
*G09G 5/10* (2006.01)

(52) U.S. Cl. ..... 345/690; 345/691

(58) Field of Classification Search ..... 345/690, 345/89

See application file for complete search history.

(56) References Cited

U.S. PATENT DOCUMENTS 6,069,609 A * 5/2000 Ishida et al. ..... 345/596
7,068,283 B2 * 6/2006 Huang ..... 345/602
2005/0231498 A1 * 10/2005 Abe et al. ..... 345/204

* cited by examiner

*Primary Examiner*—Amare Mengistu
*Assistant Examiner*—Grant D. Sitta
(74) *Attorney, Agent, or Firm*—Pai Patent & Trademark Law Firm; Chao-Chang David Pai

(57) ABSTRACT

A GAMMA adjustment method for a multi-channel driver of a monitor and device thereof are provided. The GAMMA adjustment method converts an m-bit input signal of a high bit signal corresponding to an m-bit simulated GAMMA curve into an n-bit signal of a low bit signal. Then the n-bit signal together with an n-bit input signal are input to a driver component. The driver component compares the two low-bit signals to generate a PWM driver signal supplied to a data channel of the monitor. Since the two n-bit signals of the driver component are of low quantity bit, the driver chooses n-bit digital driver components to greatly reduce an overall layout area of the driver and further to reduce manufacture cost.

5 Claims, 4 Drawing Sheets

GAMMA ADJUSTMENT METHOD FOR MULTI-CHANNEL DRIVER OF MONITOR AND DEVICE OF THE SAME

BACKGROUND OF THE INVENTION

1. Field of the Invention

The invention relates in general to a GAMMA adjustment method for a multi-channel driver of a monitor and a device of the same, and more particularly to a GAMMA adjustment method and a device thereof, which can effectively reduce an actual layout area of a driver.

2. Description of the Related Art

One of conventional multi-channel driver circuits for a digital monitor is a GAMMA adjustment method or a circuit device. Since different monitors have different channel quantities, a size of a layout area of the driver circuit is varied.

Referring to FIG. 5, a conventional data channel driver 60 is shown. The conventional data channel driver 60 includes a plurality of m-bit digital comparators 61, an m-bit counter 62, and a look-up table 63. Each of the m-bit digital comparators 61 includes two m-bit input terminals and a PWM output terminal. The two m-bit input terminals connect to an m-bit register D [m] separately. The m-bit counter 62 connects to an input terminal of one register D [m] of the digital comparators 61. The look-up table 63 includes a built-in mapping data for n-bits converting to m-bits, so as to provide for an n-bit input signal to look up a value from the look-up table to convert into an m-bit voltage signal. An output terminal of the look-up table 63 connects to the other register D [m] of each m-bit digital comparator 61. When an n-bit input signal of the driver 60 is input, the n-bit input signal is converted into a correspondent m-bit signal by the look-up table 63, and then the correspondent m-bit signal is output to the input terminal of each m-bit digital comparator 61 through the register D [m].

The above driver 60 utilizing a main function of the digital comparators 61 is used to compare an output signal of the counter 62 and an input signal of the driver 60, so as to output a driver signal to a correspondent data channel 51 of a monitor 50. Since an m-bit quantity of a counting signal is greater than an n-bit quantity of an input signal, i.e. m>n, the digital comparators 61 are required to choose an m-bit quantity as a the digital comparator, so as to be able to execute signal comparing. In this way, the n-bits input signal has to be converted into the m-bits signal by the look up table 63, so as to be able to input to the digital comparators 61 to be compared with the m-bits signal to output the driver signal successfully.

The quantity of the digital comparators 61 of the driver 60 corresponds to the quantity of the data channels of the monitor. Further, the two input terminals of each digital comparator 61 have to connect to two registers D [m] separately for keeping the input signal. Therefore, if the driver 60 is used for a monitor with multiple data-channels, a quantity of the digital comparator 61 and a quality of the register D [m] both significantly increase in multiple. Moreover, the conventional monitor has a high demand for a high resolution and pixel quantity; thereby the quantity of the drivers for the monitor is certainly increasing. Thus, the layout of the control circuit obviously becomes more complex and the cost is excessive. In order to prevent the driver circuits becoming the barrier to future development, a small-scale circuit layout and a low cost driver circuit design are necessary and even crucial for future monitor development.

SUMMARY OF THE INVENTION

In view of the above-mentioned drawbacks, it is therefore an objective of the present invention to provide a GAMMA adjustment method for a multi-channel driver of a monitor. The invention mainly converts an m-bit input signal of a high bit signal into an n-bit signal of a low bit signal based on a GAMMA signal adjustment approach wherein m is greater than n. Therefore, when the driver applies for the multi-channel monitor, low-bit digital driver components can be used to reduce an overall layout area of the monitor driver.

In order to achieve the above-mentioned object, a main technique is to apply the GAMMA adjustment method to a multi-channel driver of a monitor. Furthermore, the driver mainly includes a GAMMA adjustment unit providing a simulated GAMMA curve and a plurality of PWM driving components. The GAMMA adjustment unit is used to convert an m-bit of high bit counting signal output by a m-bit counter into an n-bit of low bit signal, and further to input to an n-bit PWM driving component. Since the n-bit driver component further receives the n-bit input signal, a PWM driver signal is generated and output to a specific data channel after the PWM driving component has compared the n-bit input signal with the converted n-bit counting signal.

According to the above-mentioned method, the two input signals for the PWM driving component are both of n-bits. Therefore, the driver can choose to use the n-bit of the low bit PWM driving component. In comparison to m-bits of high bit driver components for the conventional driver, the present invention exactly can reduce the layout area greatly, especially for the monitor of multiple data channels.

According to another object of the present invention, the present invention can be applied to a flat of a round digitized monitor. Since a driver, of the present invention uses low bit driver components, the driver can be applied to any monitor of multiple data channels. The present invention not only can reduce the layout area, but also can greatly reduce a cost accordingly.

DETAILED DESCRIPTION OF THE INVENTION

The present invention discloses a GAMMA adjustment method for a monitor and device of the same, which can be applied to any driver of the monitor having multiple data channels. Further, the present invention also can greatly reduce an area of each driver component by using a low bit driver. Therefore, the present invention can mitigate using excessive layout area of a circuit and also can reduce the manufacturer cost.

Figure 1:
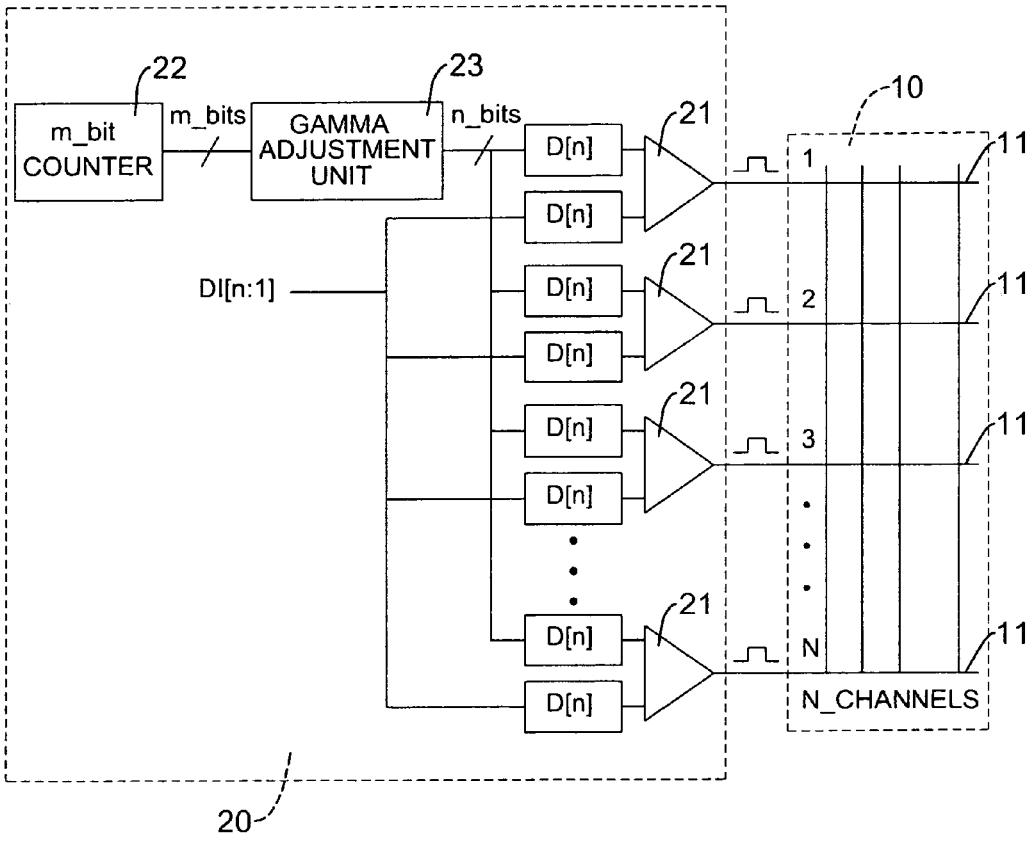
FIG. 1 shows a circuit block diagram of a driver for a monitor of multiple data channels of an embodiment of the present invention.

Referring to FIG. 1, a circuit block diagram of a driver for a monitor with multiple data channels according an embodiment of the present invention is shown. The circuit diagram includes a monitor 10 and a partial circuit of a channel driver 20. Multiple data channels 11 of the monitor 10 are correspondent to multiple output terminals of the channel driver 20 respectively. The channel driver 20 includes at least an m-bit counter 22, a GAMMA adjustment unit 23, and a plurality of PWM driving components 21.

The m-bit counter 22 is used to calculate an m-bit output signal (m-bit DI). The GAMMA adjustment unit 23 is coupled to an output terminal of the m-bit counter 22 for mapping the m-bit output signal (m-bit DI) to a specific range of a GAMMA curve, and subsequently outputting an n-bit signal (n-bit DI) mapping to the specific range, so as to output the n-bit signal (n-bit DI).

Each of the PWM driving components 21 includes two input terminals and an output terminal. One of the input terminals connects with an output terminal of the GAMMA adjustment unit 23 through a respective register D [n], and the other input terminal receives an n-bit input signal DI [n:1] through a respective register D [n]. By comparing the two n-bit input signals, a PWM driver signal is output to a corresponding data channel 11 of the monitor 10. In addition, each PWM driving component 21 is an n-bit digital comparator.

A bit quantity of the counting signal, output from the m-bit counter 22, is greater than that of the n-bit input signal DI [n:1]. That is, m is greater than n. The GAMMA adjustment unit 23 provides a GAMMA simulated curve for m-bits converting into n-bits. When the m-bits counter 22 outputs an m-bit counting signal, a n-bit counting signal is derived first by the GAMMA adjustment unit 23, and then is input to the driver component 21 together with the n-bit input signal DI [n:1]. Each PWM driving component 21 then compares the two n-bit input signals to output a PWM driver signal to a corresponding data channel 11 of the monitor 10.

Figure 2:
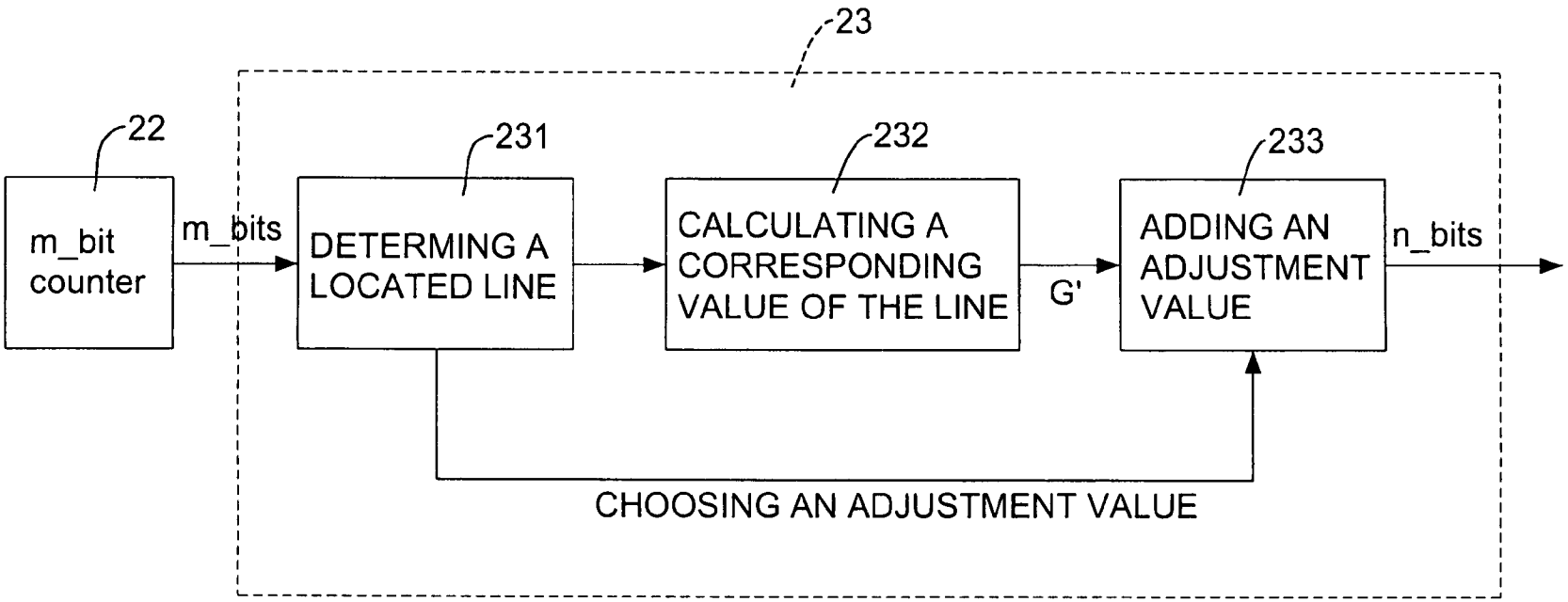
FIG. 2 shows a flow chart of a GAMMA adjustment approach of the present invention.
Figure 3:
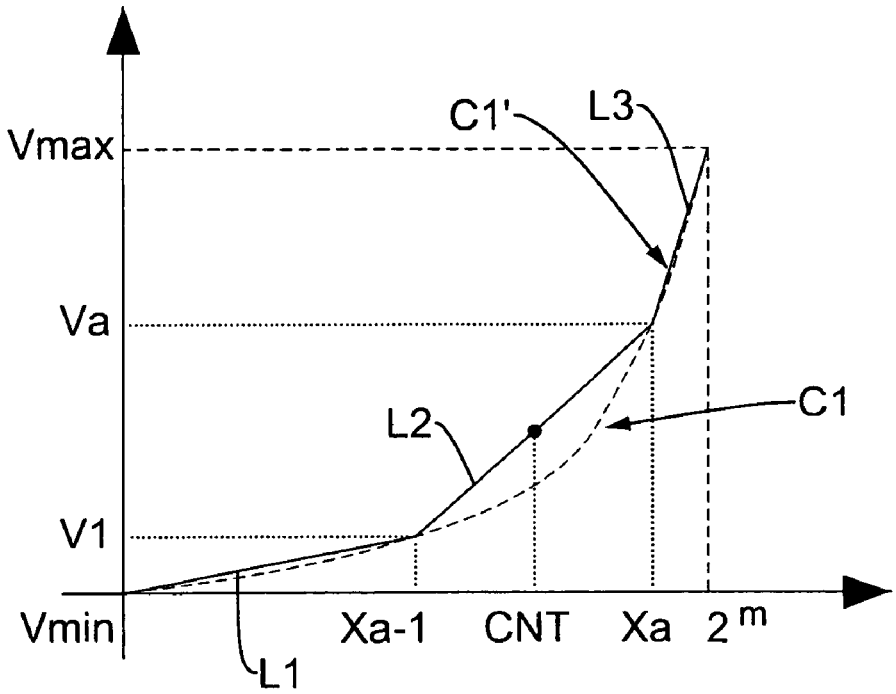
FIG. 3 shows a GAMMA curve of an m-bit signal corresponding to a specific voltage range in accordance with the present invention.
Figure 4:
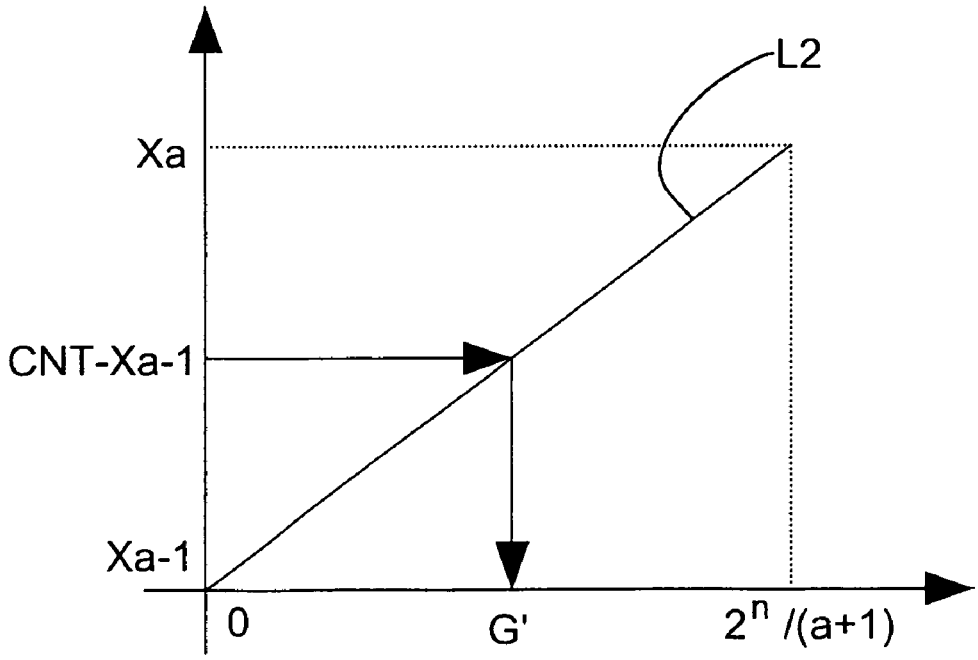
FIG. 4 shows a partial curve of FIG. 3.
Figure 5:
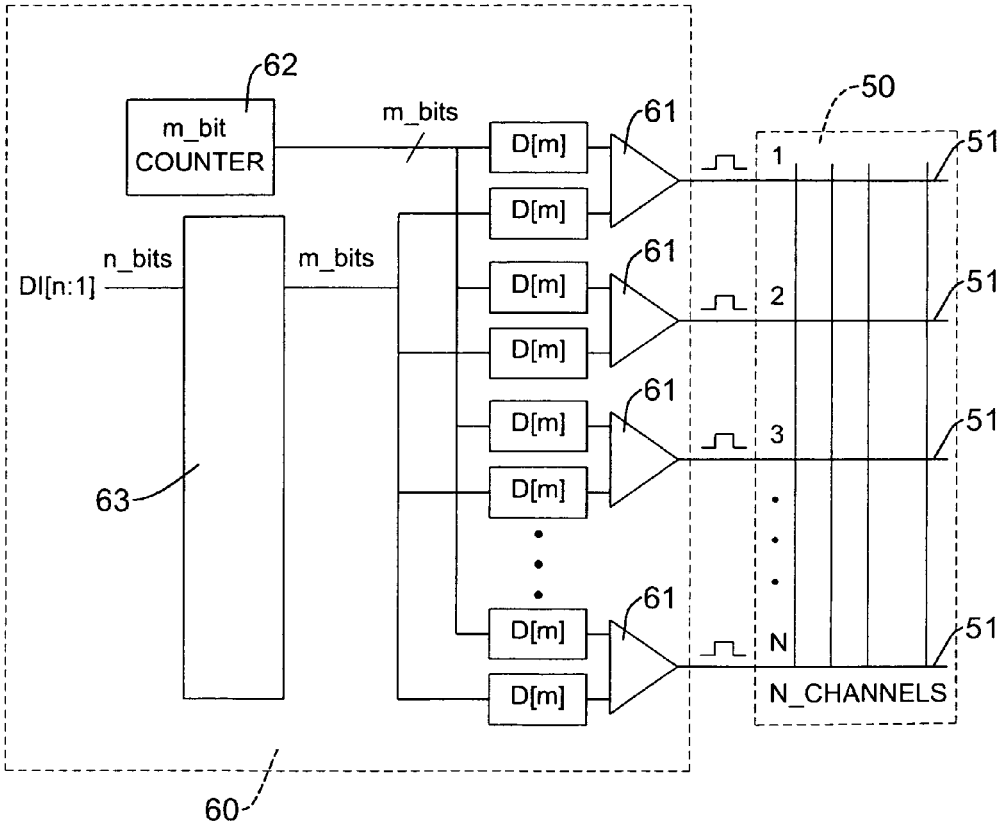
FIG.5 PRIOR ART
FIG. 5 shows a block diagram of a conventional driver for a monitor with multiple data channels.

With reference to FIG. 2, FIG. 3 and FIG. 4, processes of an adjustment method executed by the GAMMA adjustment unit 23 are shown. The method is described as follows. A located curve range of an input signal is firstly determined (step 231). As shown in FIG. 3, an approximate GAMMA curve C1' and a real GAMMA curve C1 are respectively illustrated with solid lines and dotted lines. The approximate GAMMA curve C1' represents a relationship of an m-bit signal vs. a voltage range Vmin to Vmax that are represented by n-bit values. The approximate GAMMA curve C1' comprises a plurality of lines L1, L2 and L3 with different slopes and lengths, so as to judge on which line of the L1, L2 and L3 the m-bit input signal is located and to output a minimum voltage value of the determined line. The minimum voltage value is represented by an n-bit value and used as an adjustment value in subsequence. As an example hereinafter, an m-bit input signal to be converted is denoted with CNT and located on the line L2.

A calculation formula for an n-bit voltage value G' corresponding to the m-bit input signal is calculated (step 232). According to the calculation formula, a minimum value Xa−1 of the line L2 that the m-bit input signal CNT corresponds to is subtracted from the m-bit input signal CNT, and then divided by the slope of the line L2

$$\frac{X_a - X_{a-1}}{2^n/(a+1)},$$

so as to acquire the n-bit voltage value G' correspondingly.

Then a step of adding an adjustment value is executed (step 233). The previous step 232 is calculated to acquire a relative voltage value G' of the corresponding line L2 of the m-bit input signal CNT. Therefore, the adjustment value is required to be added to acquire an actual voltage value corresponding to the m-bit signal CNT. That is, the result of the second step 232 is added to the voltage value output by the first step 231 to acquire the actual n-bit voltage value correspondingly by adjustment.

Accordingly, the GAMMA adjustment unit 23 stores an approximate GAMMA curve C1'. The quantity of lines (L1-L3) to form the approximate GAMMA curve C1' depends on a resolution of the simulated GAMMA curve C1. Further, the corresponding voltage range (Vmin to Vmax) of the approximate GAMMA curve C1' is represented by the n-bit value. Therefore when the m-bit counter 22 inputs an m-bit signal, a corresponding n-bit signal can be acquired by calculation.

Preferably, the GAMMA adjustment unit 23 is implemented by a divider. An operation formula of the divider is $$G' = \frac{CNT - X_{a-1}}{\frac{X_a - X_{a-1}}{2^n/(a+1)}};$$

wherein G' is a converted n-bit signal from the m-bit signal, CNT is the m-bit signal, Xa is a maximum value of the located line, Xa−1 is a minimum value of the located line, and a+1 is a quantity of the total lines.

A look-up table may be created to store the foregoing calculated data for mapping data for m-bits converting to n-bits where m>n. If an m-bit counting signal is input, the m-bit counting signal can be converted into an n-bit voltage signal directly by looking up the look-up table, and enabling the m-bit input signal to look up a value from the look-up table to convert into an n-bits voltage signal.

In short, the present invention uses the GAMMA adjustment unit 23 to convert the high bit input signal into the corresponding low bit signal. The low bit signal is then input to the driver component together with the low bit input signal of the driver. Since the two input signals are of low bit quantities, the driver component can use the low-bit digital comparator and the register, which is much better than the conventional driver. Each of the data channels connects to a digital comparator. Accordingly, the present invention provides the low bit digital comparator, so that the entire components of the driver can greatly reduce the layout area of the circuit and further reduce the driver cost.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-channel driver for a monitor having multiple data channels, the multi-channel driver comprising:

an m-bit counter for outputting an m-bit counting signal;

a GAMMA adjustment unit connecting to the m-bit counter and mapping the m-bit counting signal to a range of a GAMMA curve, so as to output an n-bit signal mapped by the m-bit counting signal, where m>n; and a plurality of pulse width modulation (PWM) driving components wherein each of the PWM driving components comprises two input terminals and an output terminal, wherein one of the input terminals is connected to an output terminal of the GAMMA adjustment unit to receive a first n-bit input signal through a first n-bit register, and the other one of the input terminals receives a second n-bit input signal through a second n-bit register, and each PWM driving component compares the first and the second n-bit input signals in order to output a PWM driver signal to a corresponding data channel of the monitor, wherein the GAMMA adjustment unit executes a GAMMA adjustment method comprising the steps of:

(a) determining a located curve range of an m-bit input signal, which is an m-bit counting signal output by the m-bit counter, on an approximate GAMMA curve, wherein the approximate GAMMA curve represents a relationship of a voltage range represented by n-bit values to the m-bit input signal, and the approximate GAMMA curve is formed by a plurality of lines with different slopes and lengths, so as to determine the line on which the m-bit input signal is located and to output an adjustment value, which is a minimum voltage value corresponding to the located line, represented by an n-bit value;

(b) using a calculation formula to acquire a relative n-bit voltage value corresponding to the m-bit input signal, wherein the calculation formula is $$G' = \frac{CNT - X_{a-1}}{\frac{X_a - X_{a-1}}{2^n/(a+1)}},$$

wherein G' is the relative n-bit voltage value;

CNT is the m-bit input signal;

$X_a$ is the maximum value of the located line;

$X_{a-1}$ is the minimum value of the located line; and a+1 is the quantity of the plurality of the lines; and (c) adding the adjustment value from step (a) to the relative n-bit voltage value G' from step (b) to derive an n-bit signal mapped by the m-bit input signal.

2. The multi-channel driver as claimed in claim 1, wherein each of the PWM driving components is an n-bit digital comparator.

3. The multi-channel driver as claimed in claim 1, wherein the GAMMA adjustment unit is a divider.

4. The multi-channel driver as claimed in claim 2, wherein the GAMMA adjustment unit is a divider.

5. A GAMMA adjustment method for a multi-channel driver of a monitor comprising the steps of:

(a) determining a located curve range of an m-bit input signal on an approximate GAMMA curve, wherein the approximate GAMMA curve represents a relationship of a voltage range represented by n-bit values to the m-bit input signal and the approximate GAMMA curve is formed by a plurality of lines with different slopes and lengths, so as to determine the line on which the m-bit input signal is located and to output an adjustment value, which is a minimum voltage value corresponding to the located line, represented by an n-bit value;

(b) using a calculation formula to acquire a relative n-bit voltage value corresponding to the m-bit input signal, wherein the calculation formula is $$G' = \frac{CNT - X_{a-1}}{\frac{X_a - X_{a-1}}{2^n/(a+1)}},$$

wherein G' is the relative n-bit voltage value;

CNT is the m-bit input signal;

$X_a$ is the maximum value of the located line;

$X_{a-1}$ is the minimum value of the located line; and a+1 is the quantity of the plurality of the lines, and the calculation formula is implemented by a divider; and (c) adding the adjustment value from step (a) to the relative n-bit voltage value G' from step (b) to derive an n-bit signal mapped by the m-bit input signal.

* * * * *